United States Patent [19]

MacPherson

[11] 4,259,784

[45] Apr. 7, 1981

[54] MAGNIFIED GRAPHICAL COPIER

[76] Inventor: Ruth B. MacPherson, R.D. 1 Caswell Hill Rd., Belfast, Me. 04915

[21] Appl. No.: 810,640

[22] Filed: Jun. 27, 1977

[51] Int. Cl.[2] ..... D06Q 1/00; B43L 13/00

[52] U.S. Cl. ..... 33/1 K; 33/1 BB; 33/488; 350/114; 434/90; 434/95

[58] Field of Search ..... 33/1 K, 1 BB, 1 R, 488; 35/26, 27; 350/114, 110, 115, 116

[56] References Cited

U.S. PATENT DOCUMENTS

| | | | |
|---|---|---|---|
| 241,801 | 5/1981 | Hagan | 33/1 K |
| 1,387,439 | 8/1921 | Cross | 35/26 |
| 1,622,229 | 3/1927 | Ormiston | 33/1 K |
| 2,307,358 | 1/1943 | Cloud | 33/1 K |
| 2,746,346 | 5/1956 | Gaire | 350/116 |
| 3,063,162 | 11/1962 | Quinn | 35/26 |
| 3,217,819 | 11/1965 | Allen | 350/114 X |
| 4,001,941 | 1/1977 | Cruz | 33/1 K |

FOREIGN PATENT DOCUMENTS

| | | | |
|---|---|---|---|
| 385643 | 1/1933 | United Kingdom | 35/26 |

*Primary Examiner*—William D. Martin, Jr.

[57] ABSTRACT

The four sides of a rectangular piece of screening are secured into an open frame to form a grid. Opposite lengthwise sides of the frame are grooved on the edges to make a track along which a separate piece can slide. This piece consists of a long, rectangular, magnifier lens, of a length equal to the width of the grid screen, bonded at each end into a framework the total length of which extends over the two sides of the grid frame hooking into the two side grooves of the grid frame. Height of the lens framework is dependent upon distance necessary for maximum magnification of lens. The grid frame is placed over a picture or design to be copied and, as the lens is slid along the grid frame vertically, a graph of the design is magnified for reproduction square by square into any material compartmentalized to receive the graphic presentation. The invention is particulary adapted for needlepoint rendering.

3 Claims, 6 Drawing Figures

MAGNIFIED GRAPHICAL COPIER

DESCRIPTION

This invention relates to a new and improved device, the object of which is to provide a more accurate and detailed graphical reproduction apparatus. It was developed particularly for use in copying designs into needlepoint but can be used in any medium where a design can be imitated graphically.

Another object is to provide an apparatus for immediately graphing a design by placing a grid over the design.

Another object is to provide a clearer image of the picture to be copied.

Another object is to provide a variety of grid mesh sizes.

Another object is to provide an apparatus which facilitates enlarging or condensing a picture in reproduction.

A further object is to provide a means of altering a design by distorting it.

Another object is to provide an apparatus with interchangeable grids and magnifiers, each of which could be used separately.

Another object is to provide a device easy to use.

Another object is to provide a device economical to manufacture.

With these and other objects in view the invention consists of the novel construction, formation and arrangement of parts more specifically described and claimed and illustrated in the accompanying drawings.

Figure 1A:
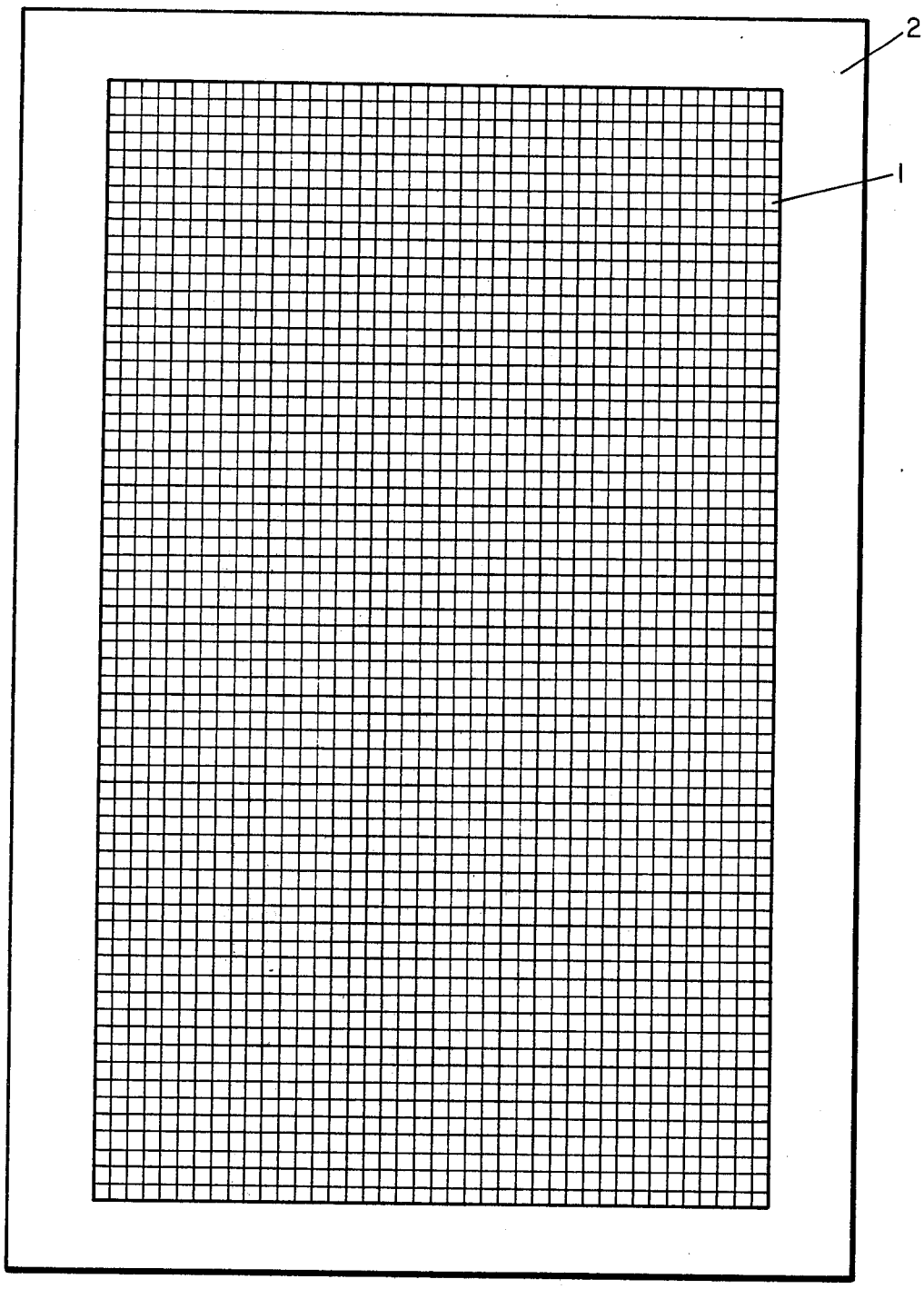

FIG. 1*a* is a plan view of the screening inserted in a frame.

Figure 1B:
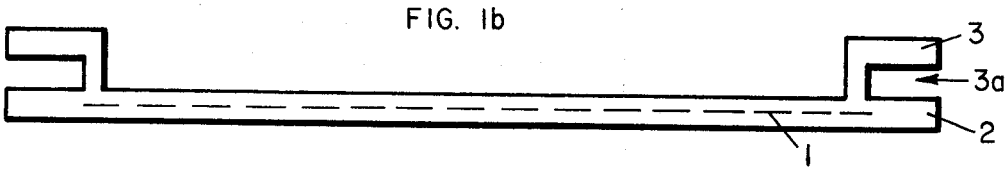

FIG. 1*b* is the end view of the frame showing the side grooves.

Figure 2A:
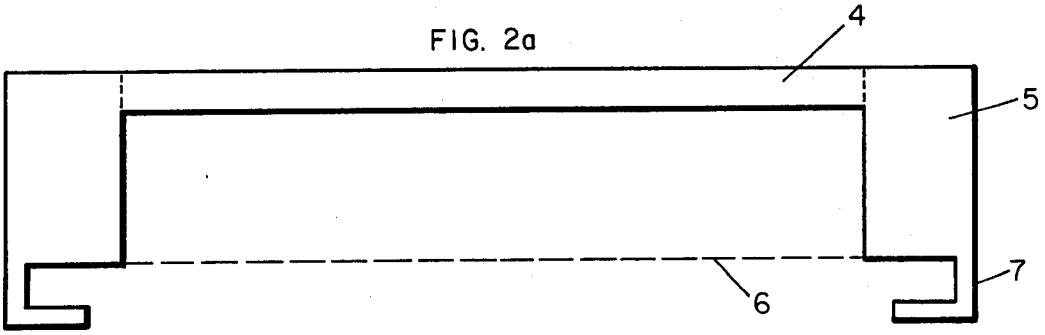

FIG. 2*a* is an end view of the sliding lens framework.

Figure 2B:
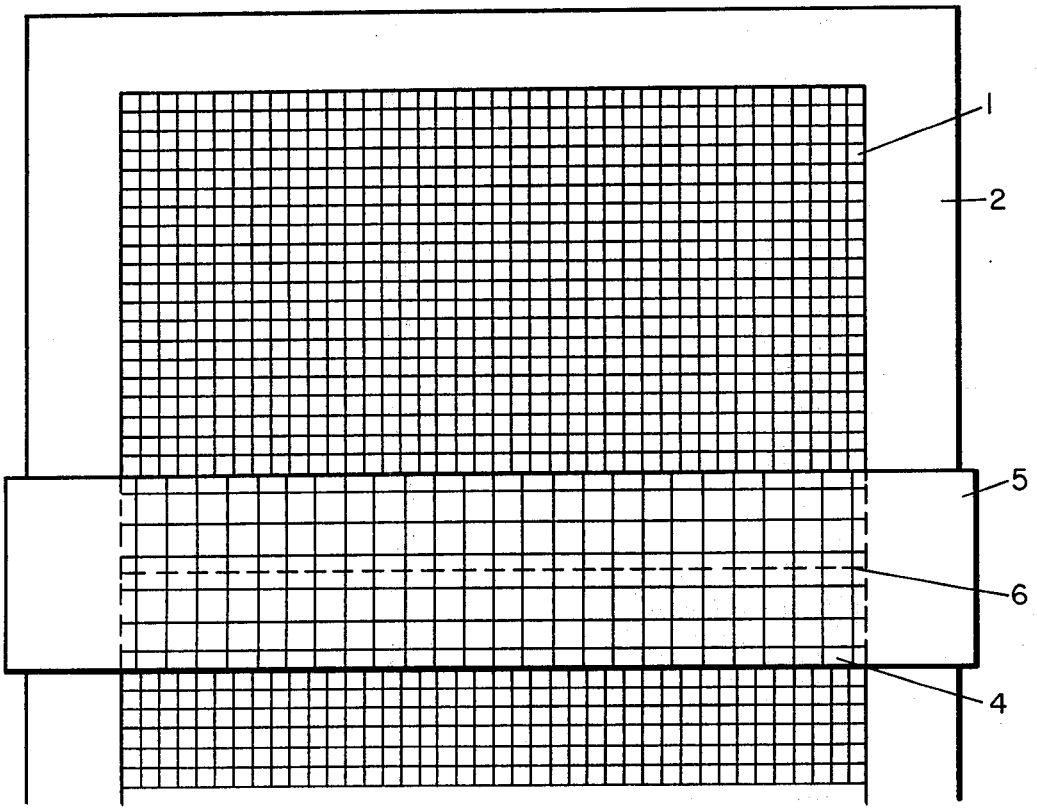

FIG. 2*b* is a plan view of the sliding lens over a grid fragmentary portion of the frame.

Figure 3A:
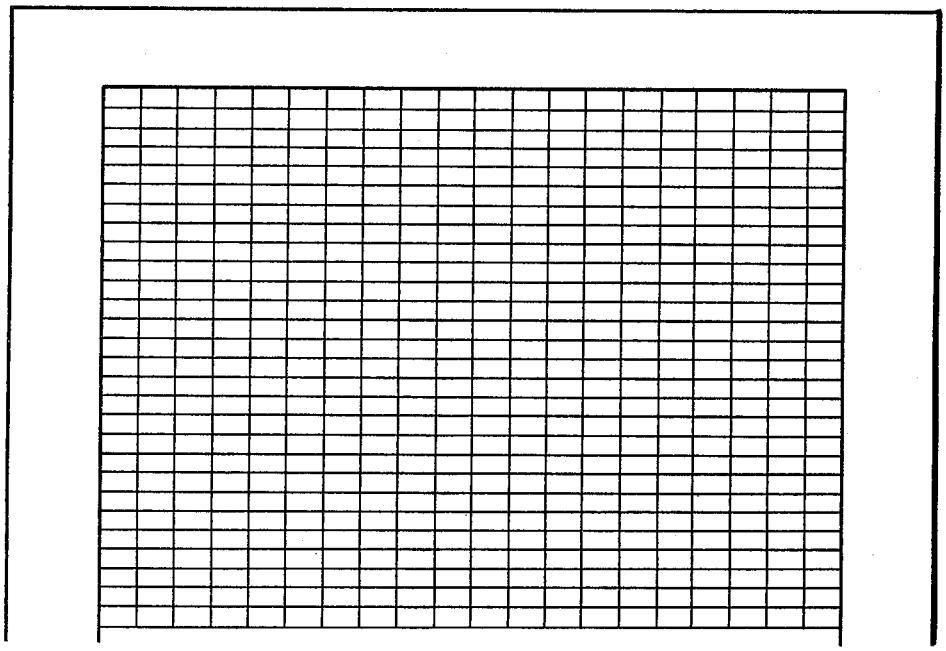

FIG. 3*a* is a fragmentary plan view of a grid which can extend a design.

Figure 3B:
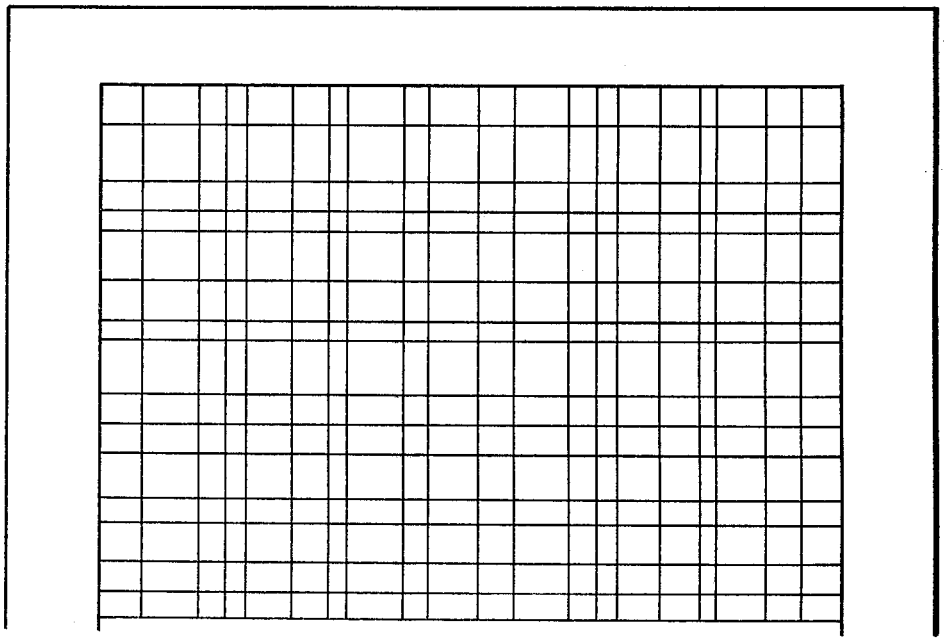

FIG. 3*b* is a fragmentary plan view of a special irregular grid.

Referring in detail to the drawings, corresponding parts are given consistent reference characters, namely: (1) is the grid screening, (2) is the grid frame, (3) is the lengthwise thickened side of the frame, 3*a* is the side groove, 4 is the magnifying lens, 5 is the sliding framework supporting the lens, 6 is a guide line and 7 is the hook of the sliding framework.

The grid frame is placed over a picture to be copied and it presents an immediate graphing of the design. I developed this device for reproducing designs into needlepoint, the canvas of which is symmetrically holed thereby enabling one to copy a design block by block from a graphic presentation. The apparatus can be used in other mediums, however, wherever a design can be copied from a graph.

The screening can be of metal, plastic wire, nylon netting or some other material which is durable but fine enough to form a visibly open mesh. I have successfully used ordinary window screening and nylon netting which are already on the market and available. Special meshes could be either be manufactured or hand strung on the frame, however.

The mesh is identified according to number of holes per inch. In FIG. 1*a* I show a mesh of 8 holes per inch (8/1"). In practice I have found grids up to 20/1" useful but I cannot rule out grids of finer mesh, however. The wire mesh is particularly convenient when copying a multiple of the same colored squares for you can click a needle in and out (along) the holes to count the stitches needed. The grid can be sectioned off vertically and horizontally by coloring wire or threads in each direction at regular intervals, thus facilitating locating your position when copying the design.

The frame for the grid must be wide and thick and durable enough to hold the mesh taut and straight. I prefer an unbreakable plastic but wood or some other material could be used. The screening (1) is secured or bonded into the inner sides of an open rectangular frame so that the holes of the mesh are lined up straight with the four sides of the frame (2). The grid should be near the bottom of the frame so that it can be close to the design to be copied when device is in use. This is necessary for most accurate reproduction of design.

The device could use various-sized grids. In needlepoint the most common canvas has 10 holes per inch in each direction. By using a grid of the same size (10/1") a design is copied block by block into needlepoint stitches hole by hole resulting in a needlepoint reproduction in the same size as the original design. If the size shown in FIG. 1*a* (8/1") were used for copying into a canvas 10/1" the needlepoint reproduction would be 20% smaller than the original. If a mesh of 20/1" were used the reproduction in a canvas 10/1" would be twice the size of the original. Thus my device can enlarge or condense a design.

If the mesh is irregular other results can be arrived at. A flattened mesh such as 4/1" horizontally and 8/1" vertically (FIG. 3*a*) will extend the reproduced picture because the flatened squares are copied into full squares. If the mesh is irregular as shown in FIG. 3*b* a distorted design can be made by copying the irregular blocks into even holes or squares row by row.

In order to accommodate a sliding magnifying lens two opposite sides of the frame are grooved. I thickened the sides of the frame to allow for the grooves and to give more strength to the frame. The entire frame could of course be thicker but I believe it would be more cumbersome and cut down on the grid visibility. Grooves could possibly be made on top of the sides of the frame but I believe the side edges afford an easier and tighter fit for the sliding piece.

The sliding lens attachment (FIG. 2*a*) consists of a long, rectangular lens (4) bonded or secured at each end into a frame (5) which subtends a hook (7) of a size to fit into the groove of the grid frame (3*a* in FIG. 1*b*). The elongate lens and downwardly extending hooks form a "bridge" over the frame. The length of the lens is equal to the width of the visible grid. The bridge framework is the width of the lens and of a height such as to allow for maximum magnification of the lens over the gridded design and it extends over each side of the grid frame enough to subtend the hooks which are of a size to slide smoothly but securely in the grooves of the grid frame.

A very thin but strong thread or wire is secured between the inner bases of the lens framework and lined up straight with horizontal grid lines. As the lens is slid over the grid this guiding line underlines each row of squares in the graph. The lens framework is preferably of plastic but could possibly be of some other material. The lens can be of glass or plastic. I have used plastic lenses $4\frac{1}{2}'' \times 1\frac{1}{4}''$ and $8\frac{1}{2}'' \times 2''$. Again this is a variable depending on size of frame desired and amount of magnification needed.

What is claimed as new is:

1. A magnifying graphical copier for copying and rendering designs in needlepoint on a needlepoint canvas having symmetrical stitch holes defining a selected needlepoint canvas mesh size comprising:

a rectangular four-sided frame, at least two opposite sides thereof having raised outer edges with grooves formed along the outer edges, said parallel grooves comprising a track for sliding engagement, said rectangular frame also formed and adapted to receive and support a grid within the sides of the frame and near the bottom of the frame whereby a grid is supported close to the design to be rendered in needlepoint for accurate reproduction;

a rectangular grid mounted within the sides of said frame near the bottom of the frame, said grid having a selected mesh size related to the needlepoint mesh whereby the design may be enlarged, reduced, transposed equally or distorted in the needlepoint rendering according to whether the grid mesh size is smaller than, larger than, equal to or of different rectangular proportions from the needlepoint mesh;

and an elongate rectangular magnifying lens formed with downwardly extending hook means at each end for sliding engagement with the track of parallel grooves at the outer edges of the frame, said lens and extending hooks forming a bridge across the frame, supporting the lens over the grid in spaced relationship for magnification, said elongate lens extending across the frame the width of the grid for magnified reading over the entire length and width of the visible grid as the lens slides along the frame.

2. A magnifying graphical copier as set forth in Claim 1 wherein the lens and extending hook means include a guiding thread across the base of the bridge below the lens thereby to afford a reference line over the grid.

3. A magnifying graphical copier as set forth in Claim 1 wherein the grid is sectioned off vertically and horizontally at regular intervals to facilitate locating positions when rendering designs in needlepoint.

* * * * *